US005607284A

United States Patent [19]

Byrne et al.

[11] Patent Number: 5,607,284

[45] Date of Patent: Mar. 4, 1997

[54] BAFFLED PASSAGE CASING TREATMENT FOR COMPRESSOR BLADES

[75] Inventors: William P. Byrne, Jupiter; Nick A. Nolcheff, Palm Beach Gardens, both of Fla.

[73] Assignee: United Technologies Corporation, Hartford, Conn.

[21] Appl. No.: 365,873

[22] Filed: Dec. 29, 1994

[51] Int. Cl.[6] ..... F01D 1/12

[52] U.S. Cl. ..... 415/58.5; 415/58.7; 415/173.4

[58] Field of Search ..... 415/58.1, 58.4, 415/58.5, 58.7, 173.4

[56] References Cited

U.S. PATENT DOCUMENTS

| | | | |
|---|---|---|---|
| 4,566,700 | 1/1986 | Shiembob | 415/173.4 |
| 5,282,718 | 2/1994 | Koff et al. | 415/58.7 X |
| 5,308,225 | 5/1994 | Koff et al. | 415/58.7 X |
| 5,431,533 | 7/1995 | Hobbs | 415/58.7 X |
| 5,474,417 | 12/1995 | Privett et al. | 415/58.5 X |

FOREIGN PATENT DOCUMENTS

| | | | |
|---|---|---|---|
| 6-207558 | 7/1994 | Japan | 415/58.5 X |

*Primary Examiner*—Edward K. Look
*Assistant Examiner*—Michael S. Lee
*Attorney, Agent, or Firm*—Christopher T. Hayes

[57] ABSTRACT

A tip shroud assembly comprising a segmented annular shroud, each segment comprising an first arcuate member having a first radially inner surface and a circumferentially extending channel extending radially outward therefrom, and a second arcuate member received within the channel in spaced relation to the first arcuate member thereby defining a circumferentially extending passage therebetween, and a plurality of baffles located in the passage, each baffle extending from the first arcuate member to the second arcuate member.

3 Claims, 3 Drawing Sheets

BAFFLED PASSAGE CASING TREATMENT FOR COMPRESSOR BLADES

DESCRIPTION

1. Technical Field

This invention relates to tip shroud assemblies of axial flow gas turbine engine compressors, and specifically to such shrouds which recirculate air at the tips of airfoil in the compressor to reduce the likelihood of compressor stall.

2. Background Art

In an axial flow gas turbine engine, such as the type used on aircraft, air is compressed in a compressor section, mixed with fuel combusted in a combustor section, and expanded through a turbine section that, via one or more shafts, drives the compressor section. The overall efficiency of such engines is a function of, among other factors, the efficiency with which the compressor section compresses the air. The compressor section typically includes a low pressure compressor driven by a shaft connected to a low pressure turbine in the turbine section, and a high pressure compressor driven by a shaft connected to a high pressure turbine in the turbine section. The high and low compressors each include several stages of compressor blades rotating about the longitudinal axis 100 of the engine, as shown in FIG. 1. Each blade 10 has an airfoil 12 that extends from a blade platform 14 and terminates in a blade tip 16, and the blade tips 16 rotate in close proximity to an outer air seal 18, or "tip shroud". The tip shroud 18 extends circumferentially about the blade tips 16 of a given stage, and the blade platforms 14 and the tip shroud 18 define the radially inner and outer boundaries, respectively, of the airflow gaspath through the compressor.

The stages are arranged in series, and as air is pumped through each stage, the air experiences an incremental increase in pressure. The total pressure increase through the compressor is the sum of the incremental pressure increases through each stage, adjusted for any flow losses. Thus, in order to maximize the efficiency of a gas turbine engine, it would be desirable, at a given fuel flow, to maximize the pressure rise (hereinafter referred to as "pressure ratio") across each stage of the compressor.

Unfortunately, one of the problems facing designers of axial flow gas turbine engines is a condition known as compressor stall. Compressor stall is a condition in which the flow of air through a portion of a compressor stage ceases, because the energy imparted to the air by the blades of the compressor stage is insufficient to overcome the pressure ratio across the compressor stage. If no corrective action is taken, the compressor stall may propagate through the compressor stage, starving the combustor of sufficient air to maintain engine speed. Under some circumstances, the flow of air through the compressor may actually reverse direction, in what is known as a compressor surge. Compressor stalls and surges on aircraft powerplants are engine anomalies which, if uncorrected, can result in loss of the aircraft and everyone aboard.

Compressor stalls in the high compressor are of great concern to engine designers, and while compressor stalls can initiate at several locations within a given stage of a compressor, it is common for compressor stalls to propagate from the blade tips where vortices occur. It is believed that the axial momentum of the airflow at the blade tips tends to be lower than at other locations along the airfoil. From the foregoing discussion it should be apparent that such lower momentum could be expected to trigger a compressor stall.

As an aircraft gas turbine engine accumulates operating hours, the blade tips tend to wear away the tip shroud, increasing the clearance between the blade tips and the tip shroud. As those skilled in the art will readily appreciate, as the clearance between the blade tip and the tip shroud increases, the vortices become greater, resulting in a larger percentage of the airflow having the lower axial momentum discussed above. Accordingly, engine designers have sought to remedy the problem of reduced axial momentum at the blade tips of high compressors.

An effective device for treating tip shrouds to desensitize the high pressure compressor of an engine to excessive clearances between the blade tips and tip shrouds is shown and described in U.S. Pat. No. 5,282,718 issued Feb. 4, 1994, to Koff et al, which is hereby incorporated by reference herein. In practice, the tip shroud assembly disclosed in U.S. Pat. No. 5,282,718, is composed of an inner ring 20 and outer ring 22 as shown in FIG. 2. In the high pressure compressor application, the rings 20, 22 are initially forged, and hundreds of small, complicated vanes 24 are machined onto one of the rings 20, 22 to direct airflow and minimize efficiency penalties. The inner ring 20 and outer ring 22 are then segmented, and the inner ring 20 is attached to the outer ring 22 by use of attachments 26 such as bolts, rivets, welding or a combination thereof. Unfortunately, experience has shown that although effective, the tip shroud assembly of the prior art is costly due to the large amount of time required to machine the vanes 24.

What is needed is a tip shroud assembly which provides some of the benefits against stall of the prior art with comparable efficiency penalties yet provides a significant reduction in manufacturing cost as compared to the prior art.

SUMMARY OF THE INVENTION

It is therefore an object of the present invention to provide a tip shroud assembly which provides benefits of the prior art tip shrouds yet provides a significant reduction in manufacturing cost, while increasing the maintainability and safety as compared to the prior art.

According to the present invention, a tip shroud assembly is disclosed comprising a segmented annular shroud, each segment comprising an first arcuate member having a first radially inner surface and a circumferentially extending channel extending radially outward therefrom, and a second arcuate member received within the channel in spaced relation to the first arcuate member thereby defining a circumferentially extending passage therebetween, and a plurality of baffles located in the passage, each baffle extending from the first arcuate member to the second arcuate member.

The foregoing and other features and advantages of the present invention will become more apparent from the following description and accompanying drawings.

BEST MODE FOR CARRYING OUT THE INVENTION

Figure 1:
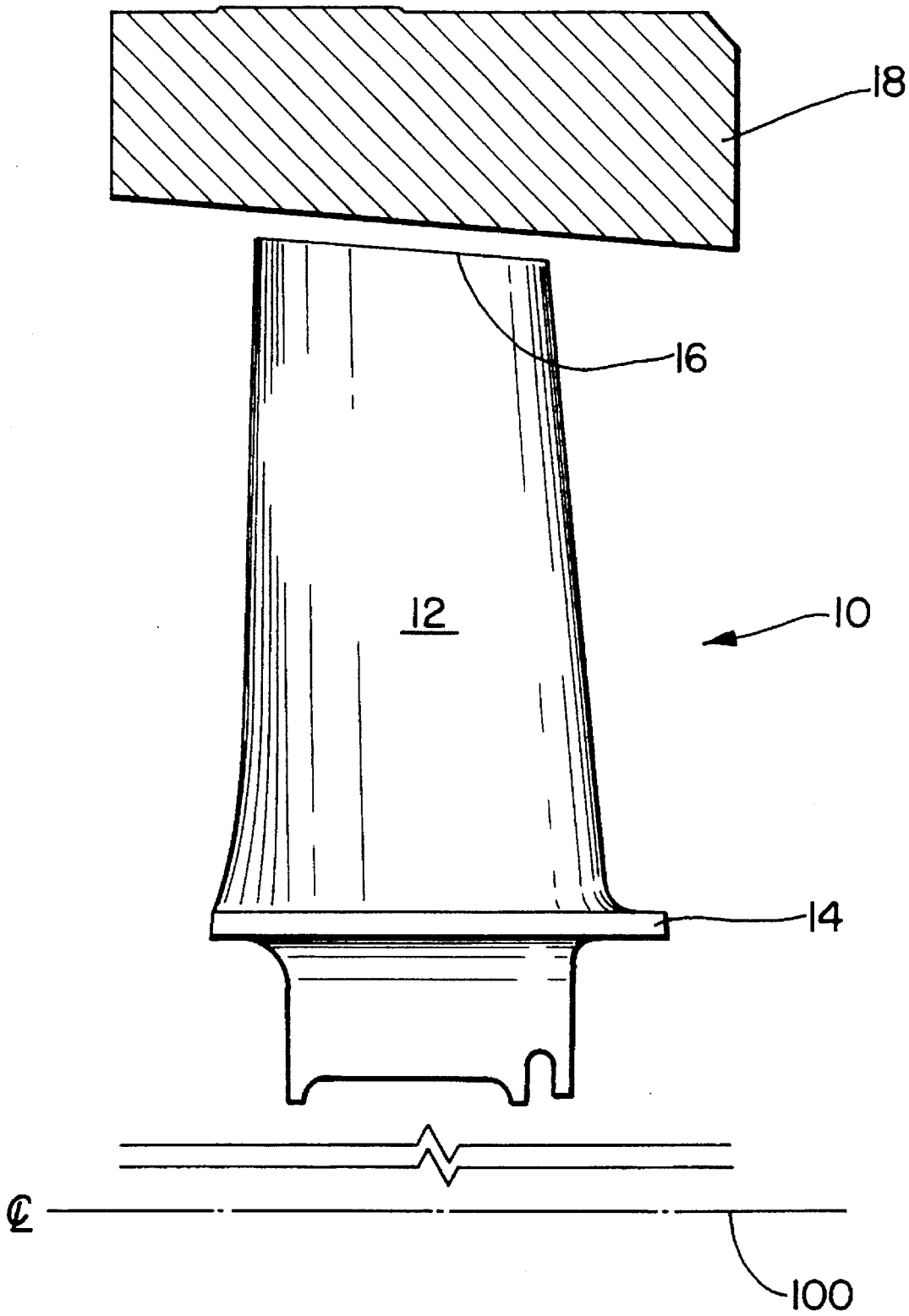
FIG. 1 (PRIOR ART)
FIG. 1 is view of a compressor blade and tip shroud of the prior art.
Figure 2:
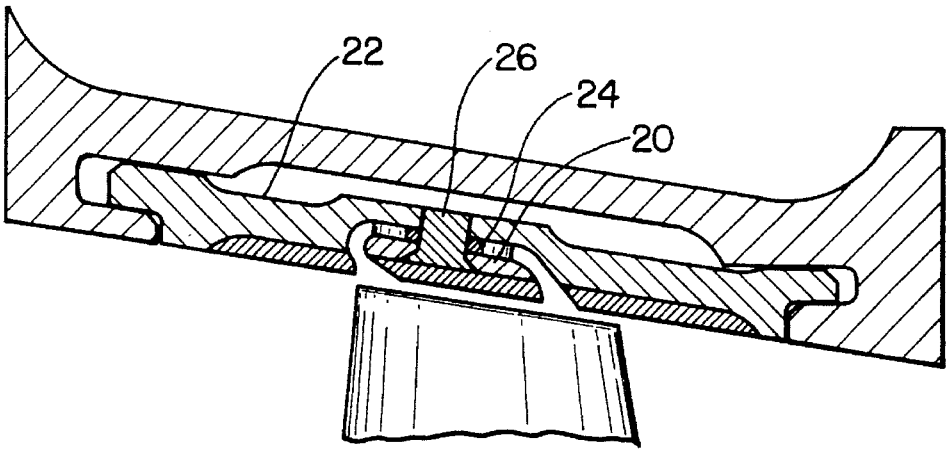
FIG. 2 (PRIOR ART)
FIG. 2 is a cross sectional view of a tip shroud of the type disclosed in U.S. Pat. No. 5,282,718.
Figure 3:
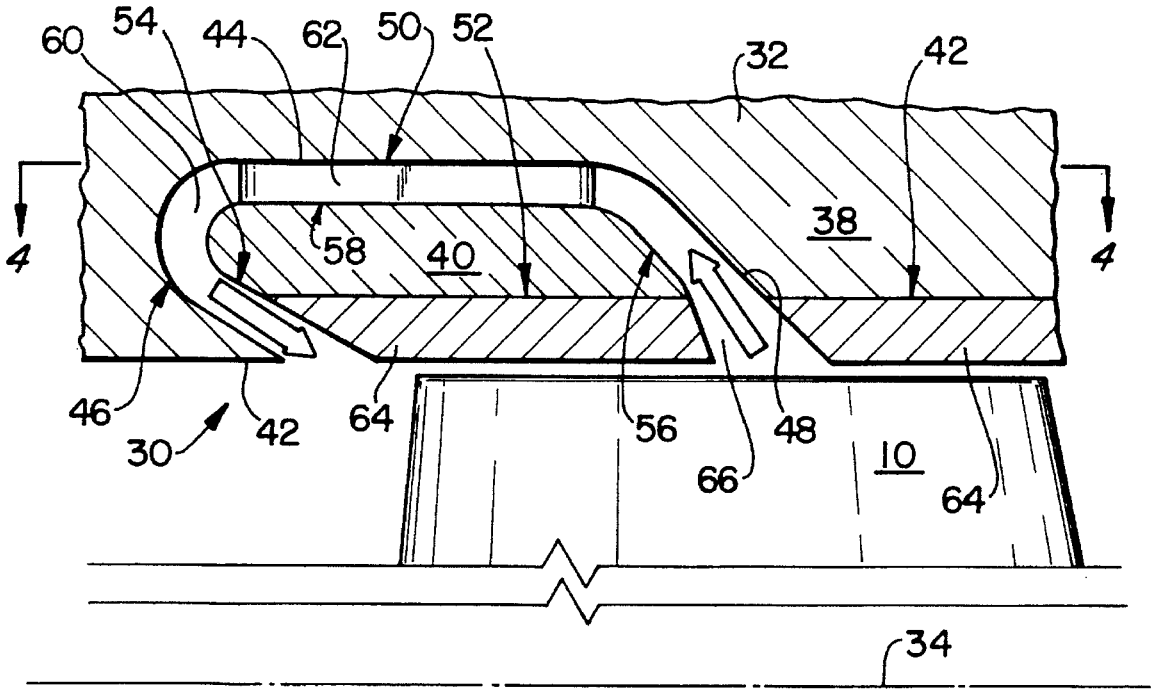
FIG. 3 is a cross sectional view of the tip shroud of the present invention.
Figure 4:
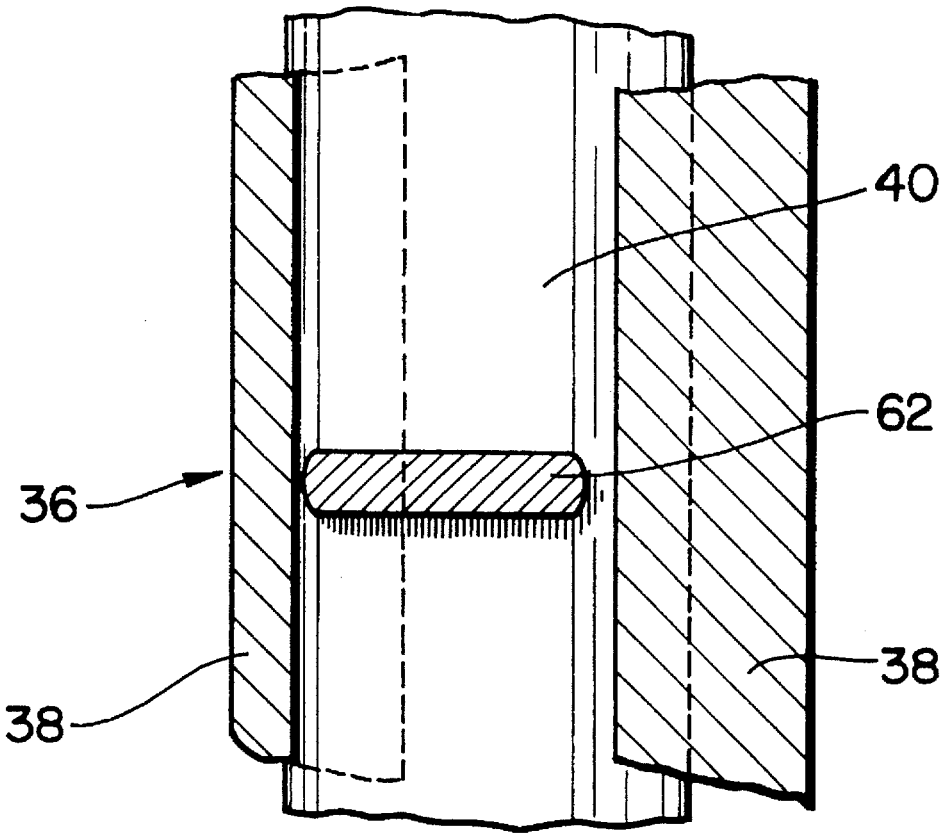
FIG. 4 is a cross sectional view of the tip shroud of the present invention taken along line 4—4 of FIG. 3.

As shown in FIG. 3, the tip shroud assembly 30 of the present invention comprises an annular shroud 32 extending circumferentially about a reference axis 34 which, once the assembly 30 is placed into an engine, defines the longitudinal axis 34 of the engine. The annular shroud 32 is comprised of a plurality of arcuate shroud segments 36, a portion of one of which is shown in FIG. 4, and each segment has a length, and the sum of the lengths defines the circumference of the annular shroud 32. Each segment 36 comprises a first arcuate member 38 and a second arcuate member 40. The first arcuate member 38 has a first radially inner surface 42 and a circumferentially extending channel 44 extending radially outward therefrom along the entire length of the segment 36. The channel 44 includes a first wall 46, a second wall 48 and a radially outer channel wall 50. The radially outer channel wall 50 connects the first wall 46 to the second wall 48, and as shown in FIG. 3, the first wall 46 is located opposite the second wall 48.

As shown in FIG. 3, the second arcuate member 40 has a second radially inner surface 52 and a third wall 54 and a fourth wall 56 extending radially outward therefrom and a radially outer member wall 58 connecting the third wall 54 to the fourth wall 56. The second arcuate member 40 is received within the channel 44 in spaced relation to the first arcuate member 38 thereby defining a circumferentially extending passage 60 therebetween. The third wall 54 is opposite the first wall 46 and the fourth wall 56 is opposite the second wall 48.

Each of the radially inner surfaces 42, 52, faces the reference axis 34, and preferably define sections of a cone. Each shroud segment 36 includes a plurality of baffles 62, and as shown in FIGS. 3 and 4, each baffle 62 is located in the passage 60. Each baffle 62 extends from the radially outer member wall 58 radially outward relative to the axis 34 to the radially outer channel wall 50. Each baffle 62 is fixed to the first and second arcuate members 38, 40, by one of the methods of the prior art, such as bolts, rivets, welding etc., thereby preventing relative movement between the first and second arcuate members 38, 40. Each baffle 62 terminates short of the first and second walls 46, 48, such that the baffle 62 does not span between the radially inner surfaces 42, 52, of the arcuate members 38, 40. A layer 64 of abradable material of the type known in the art is attached to the radially inner surfaces 42, 52 of the first and second arcuate members 38, 40 as needed for the particular engine application. The abradable material extends radially inward from the radially inner surfaces 42, 52 and the layer 64 has one or more annular channels 66 therein, each of which is located radially inward from the passage 60 and is in communication therewith.

The baffles 62 of the present invention differ from the vanes of the prior art in that although they provide a structural attachment, from an aerodynamic standpoint they merely break up swirl in the air passing through the passage. Accordingly, no more than forty baffles 62 are needed, but for structural purposes, at least twenty are preferred. The use of baffles 62 in the present invention substantially reduces the cost of manufacture over that of the prior art, making it economically competitive with current untreated shrouds, while concurrently protection from compressor stall with efficiency penalties comparable to that of the prior art.

Although this invention has been shown and described with respect to detailed embodiments thereof, it will be understood by those skilled in the art that various changes in form and detail thereof may be made without departing from the spirit and scope of the claimed invention.

We claim:

1. A tip shroud assembly for an axial flow gas turbine engine, said tip shroud assembly comprising an annular shroud extending circumferentially about a reference axis, said shroud including a plurality of arcuate segments, each segment having a length, the sum of said lengths defining the circumference of said annular shroud, each segment comprising a first arcuate member having a first radially inner surface and a circumferentially extending channel extending radially outward therefrom the length of the segment, said channel including a first wall, a second wall and a radially outer channel wall connecting said first wall to said second wall, said first wall opposite said second wall, a second arcuate member, said second arcuate member having a second radially inner surface and a third wall and a fourth wall extending radially outward therefrom and a radially outer member wall connecting said third wall to said fourth wall, said second arcuate member received within the channel in spaced relation to the first arcuate member thereby defining a circumferentially extending passage therebetween, said third wall opposite said first wall and said fourth wall opposite said second wall, and a plurality of baffles located in the passage, each baffle extending from the radially outer member wall radially outward relative to said axis to said radially outer channel wall, each baffle fixed to the first and second arcuate members thereby preventing relative movement therebetween, each baffle terminating short of said first and second walls.

2. The tip shroud assembly of claim 1 further comprising a layer of abradable material attached to the radially inner surfaces of the first and second arcuate members and extending radially inward therefrom.

3. The tip shroud assembly of claim 1 wherein plurality of baffles is a quantity of in the range of twenty to forty.

* * * * *